US005145336A

United States Patent [19]

Becker et al.

[11] Patent Number: 5,145,336

[45] Date of Patent: Sep. 8, 1992

[54] DIAPHRAGM PUMP WITH REINFORCED DIAPHRAGM

[75] Inventors: Erich Becker; Heinz Riedlinger, both of Bad Krozingen, Fed. Rep. of Germany

[73] Assignee: KNF Neuberger GmbH, Freiburg-Munzingen, Fed. Rep. of Germany

[21] Appl. No.: 664,536

[22] Filed: Mar. 4, 1991

[30] Foreign Application Priority Data

Mar. 13, 1990 [DE] Fed. Rep. of Germany ..... 4007932

[51] Int. Cl.[5] ..... F04B 45/04

[52] U.S. Cl. ..... 417/413; 92/99; 92/104

[58] Field of Search ..... 417/413; 92/99, 98 R, 92/101, 104

[56] References Cited

U.S. PATENT DOCUMENTS

| | | | |
|---|---|---|---|
| 2,545,857 | 3/1951 | Perkins et al. | 92/101 X |
| 2,711,134 | 6/1955 | Hughes | 92/99 X |
| 2,741,187 | 4/1956 | Moller | 92/99 X |
| 3,209,700 | 10/1965 | Waldherr | 92/98 R X |
| 3,212,446 | 10/1965 | Golden | 92/98 R X |
| 3,947,156 | 3/1976 | Becker | 92/99 X |
| 4,231,287 | 11/1980 | Smiley | 417/413 X |
| 4,594,059 | 6/1986 | Becker | 417/439 |
| 4,785,719 | 11/1988 | Bachschmid | 92/99 X |

FOREIGN PATENT DOCUMENTS

| | | | |
|---|---|---|---|
| 0010943 | 5/1980 | European Pat. Off. . | |
| 2211096 | 5/1976 | Fed. Rep. of Germany . | |
| 1246604 | 9/1971 | United Kingdom | 92/99 |
| 1264952 | 2/1972 | United Kingdom . | |

*Primary Examiner*—Leonard E. Smith
*Attorney, Agent, or Firm*—Peter K. Kontler

[57] ABSTRACT

A diaphragm pump wherein the marginal portion of a contoured diaphragm is clamped between the cover and the case of the pump housing and the reinforced central portion of the diaphragm is reciprocated toward and away from the inner side of the cover by the connecting rod of a crank drive. The front side of the diaphragm and the inner side of the cover define a variable-volume pumping chamber which receives a fluid medium by way of an inlet and discharges the aspirated fluid medium by way of an outlet in the cover. The diaphragm has an intermediate portion which connects the central and marginal portions and is provided with an annular flexure zone including an annular protuberance at the rear side of the diaphragm. The intermediate portion is further provided with reinforcing and stabilizing ribs which are disposed substantially radially of the central portion and extend between the protuberance and the central portion as well as between the protuberance and the marginal portion at the rear side of the diaphragm. The protuberance cooperates with the ribs to ensure that the front side of the intermediate portion of the diaphragm more accurately conforms to the adjacent portion of the inner side of the cover when the diaphragm completes its exhaust stroke.

39 Claims, 5 Drawing Sheets

PRIOR ART

DIAPHRAGM PUMP WITH REINFORCED DIAPHRAGM

BACKGROUND OF THE INVENTION

The invention relates to diaphragm pumps. More particularly, the invention relates to improvements in diaphragm pumps of the type wherein the marginal portion of a flexible diaphragm is secured to the pump housing and a central portion of the diaphragm is reciprocable by a connecting rod or in another suitable way so as to draw a fluid medium into a variable-capacity pumping chamber during movement in a first direction toward one end position, and to expel the fluid medium from the chamber during movement in the opposite direction to a second end position in which the volume of the pumping chamber is reduced to a minimum.

It is already known to provide the diaphragm of a diaphragm pump with a relatively thick central portion which is coupled to a connecting rod serving to convert rotary movements of a driving member (such as an orbiting crank pin) into reciprocatory movements of the central portion of the diaphragm. The marginal portion of the diaphragm is clamped between two sections (e.g., between a case and a cover) of the pump housing, and one side of the diaphragm defines with the inner side of the cover a variable-capacity pumping chamber which receives a fluid medium by way of one or more inlets while the central portion of the diaphragm is caused to move away from the cover. The fluid medium is expelled from the chamber during the next-following exhaust stroke, i.e., while the central portion of the diaphragm is being moved toward the cover so as to reduce the volume of the pumping chamber. The intermediate portion of the diaphragm is relatively thin and hence readily flexible in order to permit deformation of the diaphragm in the region between the reciprocating central portion and the clamped marginal portion.

It is further known to impart to the inner side of the cover a substantially concave (spherical shape) and to impart to the adjacent front side of the diaphragm a complementary convex shape. This ensures that the front side of the diaphragm can more closely conform to the shape of the inner side of the cover when the diaphragm completes its exhaust stroke. Such diaphragm pumps are often used as vacuum pumps.

A drawback of heretofore known vacuum pumps which employ a diaphragm of the above outlined character is that their fluid evacuating capacity is rather limited. One of the primary reasons for the inability of conventional diaphragm pumps to effect a more satisfactory evacuation of fluids from vessels or the like is that at least a certain part of the relatively thin and readily flexible intermediate portion between the central and marginal portions of the diaphragm often remains spaced apart from the inner side of the cover when the diaphragm completes its exhaust stroke, i.e., the volume of the pumping chamber is not reduced to zero and a certain amount of fluid medium remains in the pumping chamber while the central portion of the diaphragm abuts the inner side of the cover. It has been found that a conventional vacuum pump is incapable of establishing a vacuum in excess of approximately 75 Torr, and the main reason is the presence of dead space between the intermediate portion of the diaphragm and the cover of the pump housing while the central portion of the diaphragm abuts the adjacent concave portion of the inner side of the cover.

German Auslegeschrift No. 22 11 096 of Erich Becker discloses a diaphragm pump wherein the inner side of the cover of the pump housing is provided with a convex portion which is adjacent the outlet and conforms to the shape of adjacent portion of the front side of the diaphragm during the last stage of movement of central portion toward abutment with the concave central portion of the inner side. Thus, the configuration of the inner side of the cover departs from the shape of adjacent portions of the inner side for the express purpose of ensuring that it can be contacted by that portion of the front side of the diaphragm which is last to reach its foremost position (namely a position nearest to the cover of the pump housing). The pump of Becker is capable of considerably reducing the dead space between the diaphragm and the cover (i.e., of considerably reducing the minimum volume of the pumping chamber) when the diaphragm completes its exhaust stroke. Therefore, the pump of Becker has found wide acceptance in many branches of the industry.

A drawback of the pump of Becker is that the central portion of the diaphragm contains a relatively large mass of elastomeric material. Thus, the diaphragm must perform a pronounced fulling action during each of its exhaust strokes; such fulling entails heating and shortens the useful life of the diaphragm. Moreover, pronounced deformation of the diaphragm during the exhaust stroke reduces the ability or capacity of the pump to draw a fluid medium into its pumping chamber. Still further, the making of a cover with a specially designed inner side contributes significantly to the initial cost of the pump.

OBJECTS OF THE INVENTION

An object of the invention is to provide a diaphragm pump wherein the volume of the pumping chamber can be reduced to a greater extent than in heretofore known pumps.

Another object of the invention is to provide a novel and improved diaphragm for use in a diaphragm pump.

A further object of the invention is to provide a diaphragm pump wherein the housing can comprise a relatively simple and inexpensive cover.

An additional object of the invention is to provide a pump wherein the diaphragm is designed in such a way that it is less likely to be heated when the pump is in use than the diaphragms of heretofore known pumps.

Still another object of the invention is to provide a diaphragm the useful life of which is longer than that of conventional diaphragms.

A further object of the invention is to provide a diaphragm pump which is constructed and assembled in such a way that it can be used as a vacuum pump as well as for many other useful purposes.

Another object of the invention is to provide a diaphragm pump which can be used in connection with the conveying of gaseous and hydraulic fluids.

An additional object of the invention is to provide a novel and improved coupling between the diaphragm and the mechanism which causes the diaphragm to perform aspiration and exhaust strokes.

A further object of the invention is to provide a novel and improved method of reducing the volume of the pumping chamber when the central portion of the diaphragm in a diaphragm pump completes its exhaust stroke.

An additional object of the invention is to enhance the stability of that portion of the diaphragm in a diaphragm pump which is most likely to perform undesirable stray movements when the pump is in actual use.

Another object of the invention is to provide a simple and inexpensive but reliable mode of anchoring the marginal portion of the diaphragm in the housing of a diaphragm pump.

A further object of the invention is to reduce the bulk or mass of the diaphragm without affecting its fluid aspirating and exhausting action.

SUMMARY OF THE INVENTION

The invention is embodied in a pump which comprises a housing, a contoured deformable diaphragm and means for moving a central portion of the diaphragm relative to the housing. The housing includes a first section (e.g., in the form of a cover) and a second section (e.g., in the form of a case). The first section has an inner side which faces the second section, a fluid-admitting inlet, and a fluid-discharging outlet. In addition to the central portion, the diaphragm comprises an annular marginal portion which is sealingly received between the first and second sections of the housing, and an annular intermediate portion between the central and marginal portions. A first or front side of the diaphragm defines with the inner side of the first housing section a variable-capacity pumping chamber which communicates with the inlet and with the outlet of the first section, and the diaphragm has a second or rear side which faces away from the first section. The moving means can include an orbiting crankpin in the second section and a connecting rod which connects the crankpin with the central portion of the diaphragm and serves to move the central portion between a first end position in which the first side of the diaphragm is closely adjacent and at least substantially conforms to the inner side of the first housing section and a second end position in which the first side of the diaphragm is remote from the inner side of the first section. In accordance with a feature of the invention, the intermediate portion of the diaphragm includes an annular flexure zone where the diaphragm is flexed between the central and marginal portions during movement of the central portion between its first and second end positions, and stabilizing means provided at the second side of the diaphragm and including a portion which is disposed between the flexure zone and at least one of the central and marginal portions.

The aforementioned portion of the stabilizing means preferably comprises one or more reinforcing ribs or teeth for the respective part of intermediate portion of the diaphragm.

The thickness of the central portion of the diaphragm preferably at least matches or exceeds the thickness of the marginal portion and/or intermediate portion. The average thickness of the marginal portion can equal or exceed the thickness of the intermediate portion of the diaphragm.

In accordance with a presently preferred embodiment, the stabilizing means comprises at least one first rib or an analogous reinforcing member between the marginal and intermediate portions of the diaphragm, and at least one second rib or an analogous reinforcing member between the central and intermediate portions of the diaphragm.

The inner side of the first housing section preferably includes a concave portion, and the first side of the diaphragm includes a central portion which is convex, at least in the first end position of the central portion. The radius of curvature of the concave portion of the inner side of the first housing section preferably equals or at least closely approximates the radius of curvature of convex portion of the first side of the diaphragm in the first end position of the central portion. The inner side of the first housing section can further include an annular frustoconical portion which surrounds and is preferably substantially tangential to the concave portion.

The intermediate portion of the diaphragm can further comprise at least one additional annular zone which surrounds or is surrounded by the flexure zone. The thickness of the flexure zone at least equals but can exceed the thickness of the additional annular zone. The flexure zone can include an annular protuberance at the second side of the diaphragm. The protuberance has an annular top land which faces away from the first side of the diaphragm, and the reinforcing member or members of the stabilizing means preferably have second top lands which are at least substantially flush with the top land of the protuberance.

The pump can further comprise a stiffening insert which couples the central portion of the diaphragm to the moving means, e.g., to the aforementioned connecting rod. The insert preferably includes a first portion (e.g., in the form of a disc) which is at least substantially embedded in and is vulcanized or otherwise reliably secured to the central portion, and a second portion which connects the first portion (and hence the central portion of the diaphragm) with the moving means.

The central portion of the diaphragm can include a nipple at the second side of the diaphragm, and the stabilizing means can include a set of reinforcing ribs between the flexure zone and the nipple. As mentioned above, the top lands of such ribs are or can be flush with the annular protuberance of the flexure zone. The ribs can extend substantially radially of the nipple, and the stabilizing means can include a second set of reinforcing ribs which are disposed between the protuberance of the flexural zone and the marginal portion of the diaphragm. Each reinforcing rib of the second set can be aligned with a reinforcing rib of the set of ribs between the central portion of the diaphragm and the flexure zone.

The thickness of that additional annular zone of the intermediate portion which extends between the flexure zone and the marginal zone is or can be less than the thickness of the marginal portion of the diaphragm.

The stabilizing means can include or constitute a skeleton frame at the second side of the diaphragm. The flexure zone and the marginal portion of the diaphragm can form component parts of such skeleton frame. The arrangement is preferably such that the marginal portion and the flexure zone respectively constitute an outer ring and an inner ring of the skeleton frame, and the aforementioned portion of the stabilizing means further includes reinforcing ribs between the two rings. The two rings and the reinforcing ribs between them can define an annulus of substantially trapeziform recesses or depressions. Such diaphragm preferably further comprises an annular membrane which is disposed at the first side of the diaphragm and is integral with the reinforcing ribs between the two rings of the skeleton frame (such ribs are disposed at the second side of the diaphragm, i.e., at that side of the membrane which faces away from the pumping chamber). The thickness of the membrane can equal or approximate the thickness of the ribs (as measured in a direction from the first toward the second side of the diaphragm).

The marginal portion of the diaphragm can comprise a circumferentially complete or interrupted annular flange which is received in a complementary recess or groove of one of the housing sections. It is presently preferred to provide the flange at the second side of the diaphragm so that it can be received in a recess of the second section of the housing.

The pump can further comprise a flexible coating, layer or film which overlies and adheres to the first side of the diaphragm and consists of a material which is inert to the fluid flowing into the pumping chamber by way of the inlet during aspiration strokes of the diaphragm (i.e., while the central portion of the diaphragm moves toward its second end position) and out of the chamber by way of the outlet during exhaust strokes of the diaphragm (at such time, the central portion of the diaphragm is caused to move toward its first end position). For example, the film can consist of or can contain polytetrafluoroethylene.

The stabilizing means (and particularly the reinforcing member or members between the flexure zone and the central portion of the diaphragm) is preferably designed and dimensioned in such a way that it can effectively oppose excessive deformation of the intermediate portion between the flexure zone and the central portion of the diaphragm during movement of the central portion toward its first end position as well as that the stabilizing means can pull the flexure zone away from the inner side of the first housing section during movement of the central portion toward its second end position.

The pump can further comprise a rigid support which is carried by the moving means at the second side of the diaphragm. The configuration and mounting of the support are preferably such that the flexure zone of intermediate portion of the diaphragm abuts the support during movement of the central portion toward its first end position. The support can abut at least some reinforcing members of the stabilizing means at least during movement of the central portion of the diaphragm toward its first end position. The front surface of the support (namely the surface which confronts the pumping chamber) preferably lies flush at least against a part of the flexure zone and at least against a part of the stabilizing means, at least during movement of central portion of the diaphragm toward its first end position. The support can resemble a dish and preferably includes a rim which abuts the second side of the diaphragm at least during movement of the central portion toward its first end position. The rim can abut the second side of the diaphragm in the region of the flexure zone of intermediate portion of the diaphragm. Such rim can extend beyond the flexure zone of the intermediate portion toward the marginal portion of the diaphragm to abut the reinforcing members between the flexure zone and the marginal portion at least in the first end position of the central portion. The rim can be provided with a conical surface which is adjacent the marginal portion of the diaphragm and tapers toward the second side of the diaphragm in a direction from the marginal portion toward the central portion to abut the reinforcing members of the stabilizing means between the flexure zone and the marginal portion, at least in the first end position of the central portion of the diaphragm.

The aforementioned insert can have a substantially T-shaped cross-sectional outline; as mentioned above, the insert can include a first portion which is at least partially embedded in the central portion of the diaphragm and a second portion which connects the first portion with the moving means.

The top lands of reinforcing members between the flexure zone of the intermediate portion and the central portion of the diaphragm preferably slope from the central portion toward the flexure zone in a direction toward the pumping chamber and make an acute angle with a plane which is normal to the direction of reciprocatory movement of the central portion between its end positions. The top lands of the aforementioned reinforcing members face away from the pumping chamber. The magnitude of the acute angle is selected in such a way that the reinforcing members of the set between the central portion and the flexure zone can transmit deformation-opposing forces (by way of the flexure zone) to the reinforcing members between the marginal portion and the flexure zone during movement of the central portion toward its first end position.

The combined thickness of the aforementioned membrane (between the flexure zone and the marginal portion of the diaphragm) and the ribs of the set between the flexure zone and the marginal portion preferably at most equals the thickness of the marginal portion of the diaphragm.

The reinforcing members between the flexure zone and the marginal portion and/or central portion of the diaphragm are preferably elongated and can be bounded by substantially flat flanks. Such flanks extend from the rear or second side of the membrane to the top lands of the respective reinforcing members between the flexure zone and the marginal portion. Analogously, the flanks of reinforcing members between the flexure zone and the central portion of the diaphragm extend from the rear or second side of that additional annular zone of the intermediate portion which is disposed between the flexure zone and the central portion to the top lands of such reinforcing members.

The ratio of the diameter of the diaphragm to the thickness of the membrane of the intermediate portion can be in the range of 60:1 and 120:1.

The novel features which are considered as characteristic of the invention are set forth in particular in the appended claims. The improved diaphragm pump itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
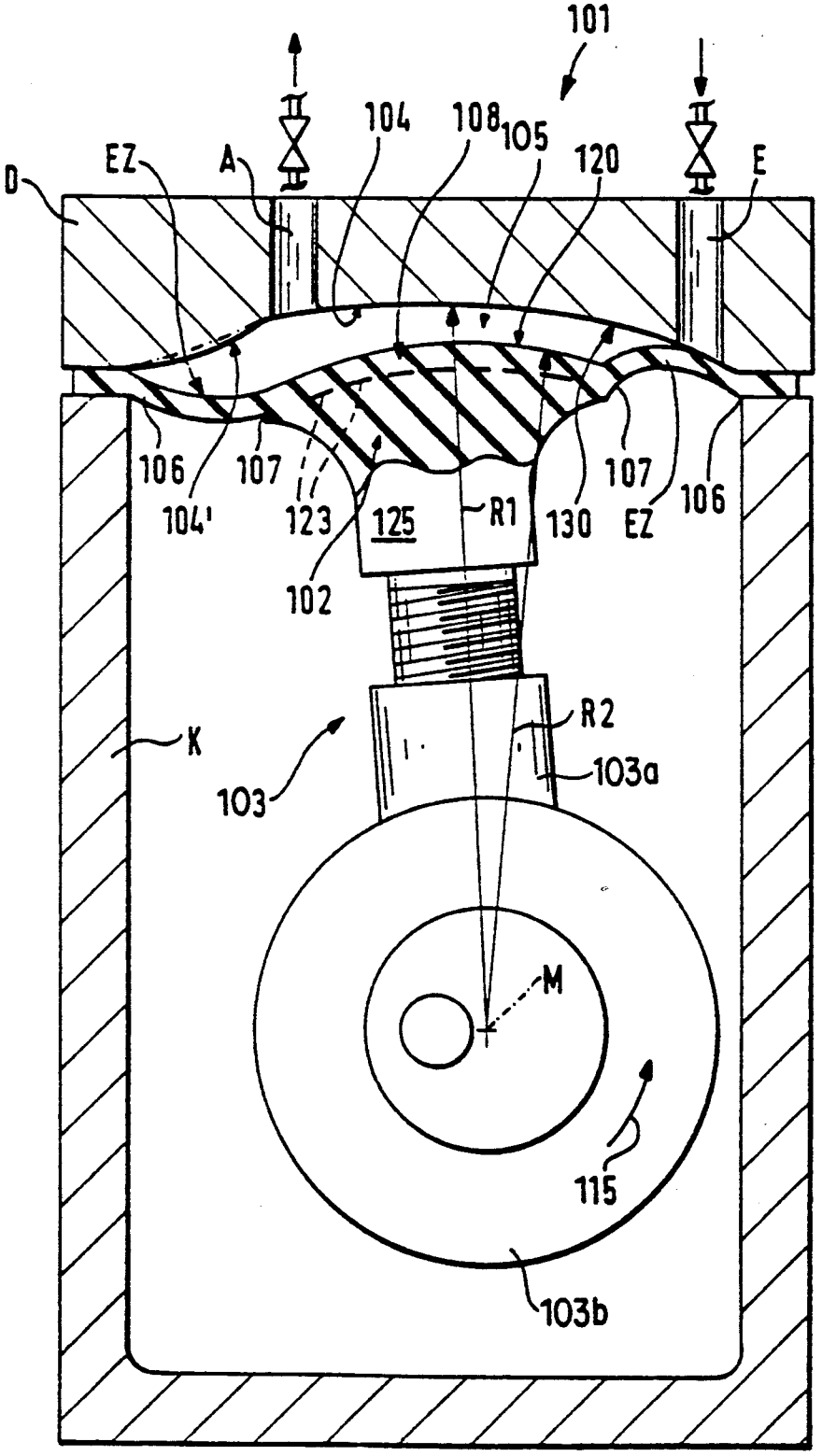
FIG. 1 is a sectional view of a conventional diaphragm pump.

FIG. 1 shows certain parts of a conventional diaphragm pump 101 which is designed for use as a vacuum pump. The housing of the pump 101 comprises a first section or cover D and a second section or case K. The sections K and D of the housing cooperate to sealingly engage and clamp the marginal portion 106 of a deformable elastic diaphragm 102. The cover D is provided with a fluid-admitting inlet E and a fluid-discharging outlet A, and the inner side 104 of the cover defines with the adjacent first or front side 120 of the diaphragm 102 a variable-volume pumping chamber 105. The chamber 105 receives a fluid medium via inlet E during each aspiration stroke of the central portion 108 of the diaphragm 102, and the thus drawn fluid medium is expelled via outlet A during each exhaust stroke of the central portion 108. The housing of the pump 101 normally further comprises a so-called head plate and a valve plate which are outwardly adjacent the cover D but are not shown in FIG. 1. Reference may be had to commonly owned U.S. Pat. No. 4,594,059 to Erich Becker.

The central portion 108 of the diaphragm 102 is relatively thick and substantially rigid in the region within its marginal zone 107. A more readily flexible annular intermediate portion EZ of the diaphragm 102 connects the central portion 108 with the marginal portion 106 and is flexed whenever the central portion performs an aspiration stroke or an exhaust stroke. The thickness of the intermediate portion EZ is substantially constant and matches or is slightly less than the thickness of the marginal portion 106.

The central portion 108 of the diaphragm 102 has a nipple 125 which extends in a direction away from the front side 120 and is rigidly connected with an externally threaded shank serving to connect the central portion 108 with a moving or reciprocating device 103, e.g., a crank drive including an orbiting crank pin **103*b* which is connected with a connecting rod 103*a*. The latter is connected with the shank which, in turn, is secured to the nipple 125 and serves to convert orbital movements of the crank pin 103*b* into reciprocatory movements of central portion 108 of the diaphragm 102. The externally threaded shank is preferably vulcanized to the nipple 125 of the central portion 108**.

The central portion or part of the inner side 104 of the cover D is concave and can constitute a portion of a spherical surface; such spherical portion of the inner side 104 is at least substantially complementary to the adjacent (convex) central portion of the front side 120 of the diaphragm 102, at least when the central portion 108 reaches a first or front end position in which the volume of the pumping chamber 105 is reduced to a minimum. The radius of curvature R1 of the concave central portion of the inner side 104 equals the radius of curvature R2 of the convex central portion of the front side 120 of the diaphragm 102 in the first or front end position of the central portion 108. The center of curvature of the central portion of the inner side 104 is on the axis M of the bearing of the moving means 103. When the central portion 102 reaches the end of its forward or exhaust stroke, the volume of the pumping chamber 105 is reduced to a minimum but is not zero. Thus, the central portion of the front side 120 abuts the central portion of the inner side 104 but the remaining portion of the front side 120 does not contact the adjacent portion of the inner side 104 all the way around the central portion 108. Otherwise stated, the entire central portion 108 is likely to actually contact the cover D but not the entire intermediate portion EZ.

FIG. 1 shows the connecting rod **103*a* of the moving means 103 and the central portion 108 of the diaphragm 102 in an intermediate position in which the convex central portion of the front side 120 is still (or already) spaced apart from the central portion of the inner side 104. It is assumed that the crank pin 103*b* orbits in the direction of the arrow 115, i.e., that the central portion 108 of the diaphragm 102 is in the process of performing an exhaust stroke and is on the way toward the cover D. During the last stage of exhaust stroke of the central portion 108, that part (at the arrowhead of the lead line of the character EZ) of the intermediate portion EZ which lags behind the remaining major part of the portion EZ actually performs a short stroke away from the cover D. The presence of a clearance or dead space between the sides 104 and 120 at the arrowhead of lead line of the character EZ is avoided, or substantially avoided, by imparting to the corresponding portion or part 104' of the inner side 140 a convex shape so that the configuration of the part 104' conforms to the configuration of adjacent portion or part of the front side 120 when the central portion 108 completes its exhaust stroke. This enables the pump 101 to further reduce the volume of the pumping chamber 105 in the front end position of the central portion 108**.

The convex portion or part 104' of the otherwise partly concave and partly conical inner side 104 is exaggerated in FIG. 1 for the sake of clarity. The distance between the convex part 104' of the inner side 104 and the adjacent part of the front side 120 (as compared with the distance between the sides 104, 120 at the arrowhead of the lead line of the character 130) is also exaggerated in FIG. 1 for the sake of clarity. Nevertheless, and when the configuration of the inner side 104 and the configuration of the front side 120 correspond to the configuration of such sides in an operative diaphragm pump 101 of the type shown in FIG. 1, the provision of the convex part 104' on the inner side 104 contributes to a detectable reduction of the dead space in the front end position of the central portion 108.

The thickness of the intermediate portion EZ of the diaphragm 102 cannot be reduced at will because a relatively thin intermediate portion would be even more likely to contribute to the development of a dead space or clearance between the sides 104, 120 in the upper end position of the central portion 108. In other words, a part of the intermediate portion EZ is more likely to remain out of contact with the cover D in the front end position of the central portion 108 if the thickness of the intermediate portion EZ is reduced. It is further desirable to ensure that the deformability of the central portion 108 be relatively low or nil because this is more likely to ensure that the convex central part of the front side 120 will actually abut the entire concave central part of the inner side 104 of the cover D. Therefore, it is customary to provide the central portion 108 with an internal reinforcement which is indicated by broken lines, as at 123.

Diaphragm pumps of the type shown in FIG. 1 are used with considerable success for the establishment of so-called medium high or fine vacuum (normally considered to be between 1 and $10^{-3}$ Torr). However, a drawback of diaphragms of the type shown in FIG. 1 is that their fulling action is rather pronounced so that they are likely to be heated and their useful life is relatively short.

Figure 2:
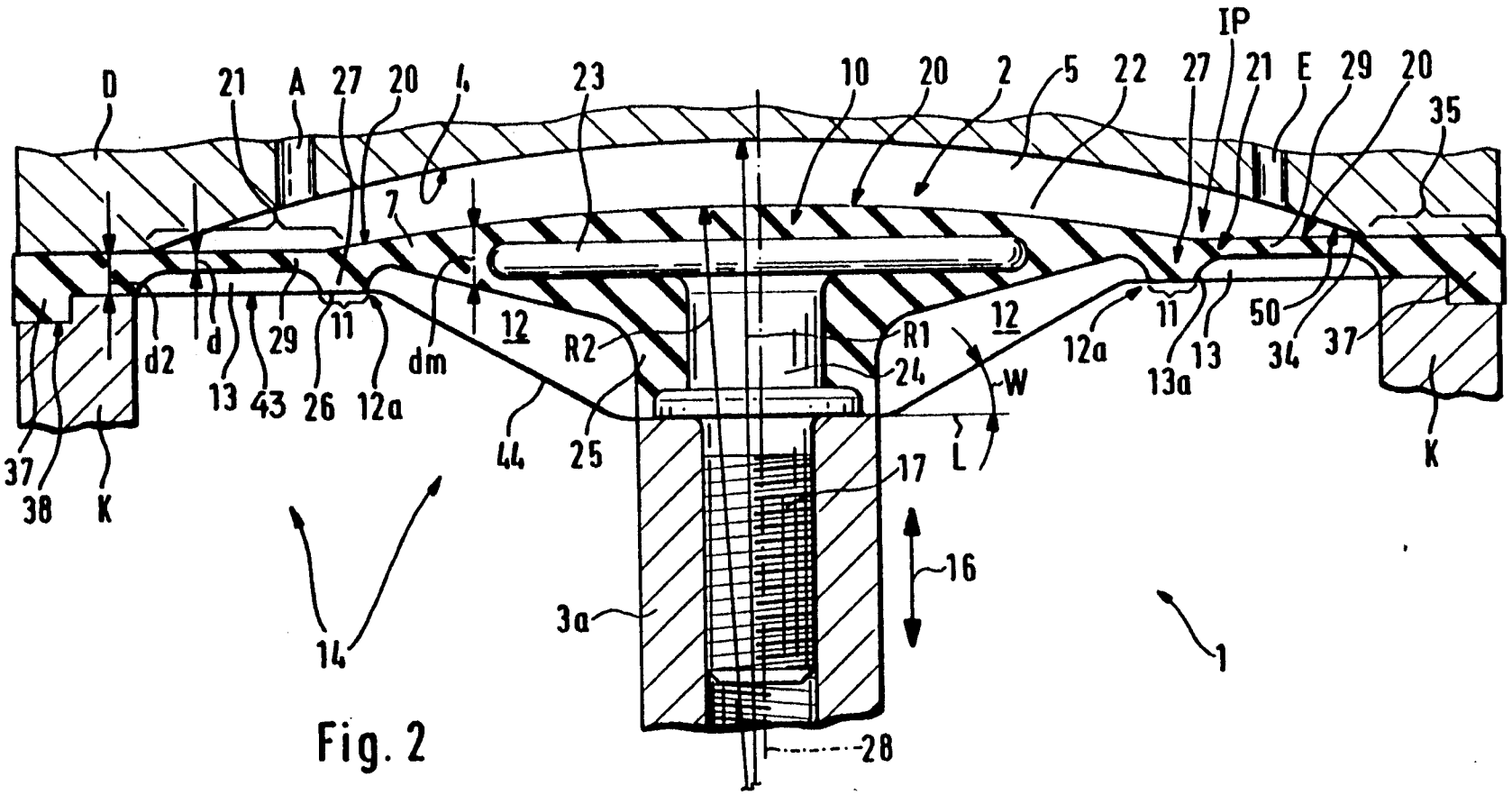
FIG. 2 is a fragmentary sectional view of a diaphragm pump which embodies one form of the invention.

FIG. 2 shows all such details of a novel and improved diaphragm pump 1 which depart from the corresponding details of a conventional pump 101. The housing of the pump 1 is or can be identical with the housing of the pump 101, i.e., it also comprises a first section or cover D and a second section or case K. All other parts of the pump 1 which are identical with or clearly analogous to corresponding parts of the conventional pump 101 are denoted by similar reference characters minus 100.

The annular marginal portion 35 of a novel and improved deformable contoured elastic diaphragm 2 which is used in the pump 1 of FIG. 1 is sealingly engaged and clamped between the neighboring surfaces of the cover D and case or section K. The relatively thick and rather rigid generally disc-shaped central portion 10 of the diaphragm 2 is reciprocable in the directions indicated by a double-headed arrow 16 in response to starting of a moving means which can include a crank drive and of which only a connecting rod 3*a* is actually shown in FIG. 2. The diaphragm 2 further comprises an annular intermediate portion IP which is disposed between and connects the portions 10 and 35 to each other. The intermediate portion IP includes an annular flexure zone 11, a first additional annular zone 21 between the flexure zone 11 and the marginal portion 35, and a second additional annular zone 7 between the flexure zone 11 and the central portion 10.

Figure 6:
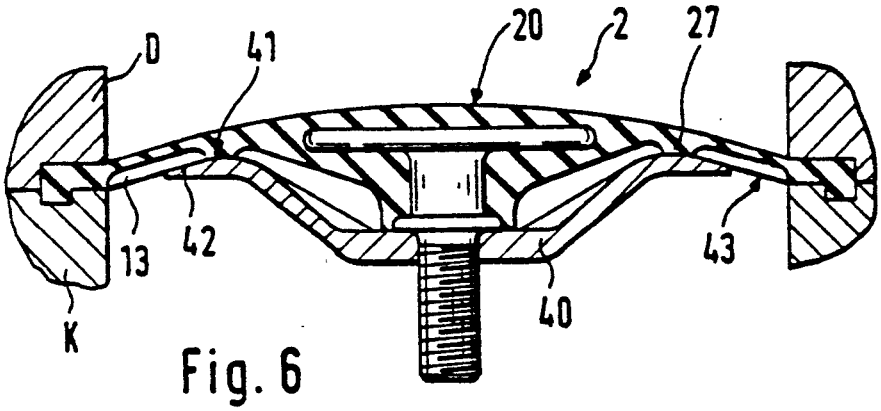
FIG. 6 shows the structure of FIG. 5 but with the diaphragm in an end position it assumes upon completion of an exhaust stroke.
Figure 7:
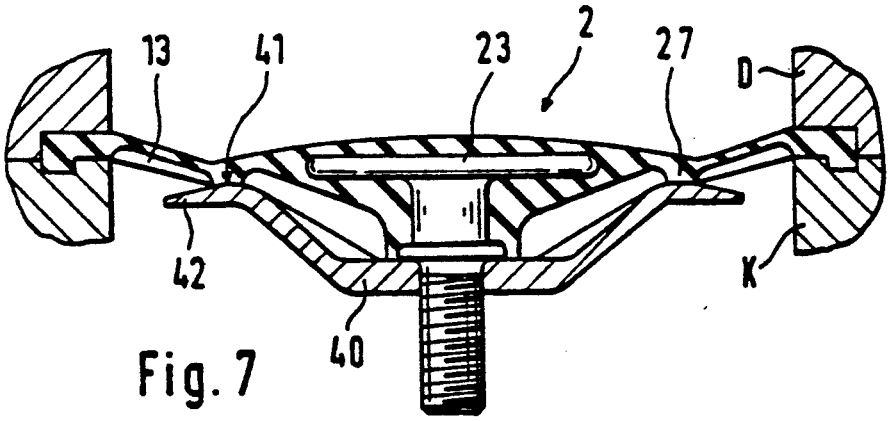
FIG. 7 shows the structure of FIG. 6 but with the diaphragm in the other end position.

The pump 1 further comprises an insert which has a substantially T-shaped sectional outline and includes a disc-shaped portion 23 which is fully embedded in and is vulcanized to the central portion 10, an externally threaded shank 17 which is received in a tapped axial bore of the connecting rod 3*a*, and a portion 24 which is at least partially surrounded by a nipple 25 of the central portion 25 and is integral with the portion 23 as well as with the shank 17. The portion 24 is or can be vulcanized to or otherwise more or less permanently secured to the nipple 25. The insert including the portions 23, 24 and the shank 17 can be said to constitute a coupling or connecting device which converts angular movements of a driving part of the moving means for the central portion 10 into reciprocatory movements of the central portion 10. The disc-shaped portion 23 of the insert ensures that the configuration of the convex central portion or part of the first or front side 20 of the diaphragm 2 remains at least substantially unchanged while the central portion 10 performs alternating exhaust and aspiration strokes and thereby moves between a first or front end position (shown in FIG. 6) and a second or rear end position (shown in FIG. 7), namely a position at a minimal distance and a position at a maximal distance from the concave central part of the inner side 4 of the cover D.

The crank drive including the connecting rod 3*a* constitutes but one of several suitable moving means which can be used in the section or case K of the pump housing to reciprocate the central portion 10 of the diaphragm 2 between its first and second end positions.

The inner side 4 of the cover D defines with the front side 20 of the diaphragm 2 a variable-volume pumping chamber 5 which can receive a gaseous or hydraulic fluid by way of an inlet E of the cover D and can discharge such fluid medium by way of an outlet A in the cover D. The radius of curvature R1 of the concave central portion or part of the inner side 4 preferably matches or at least very closely approximates the radius of curvature R2 of the central portion or part of the front side 20, at least when the central portion 10 completes an exhaust stroke and is located at a minimum distance from the exposed outer side (not shown) of the cover D.

Figure 3:
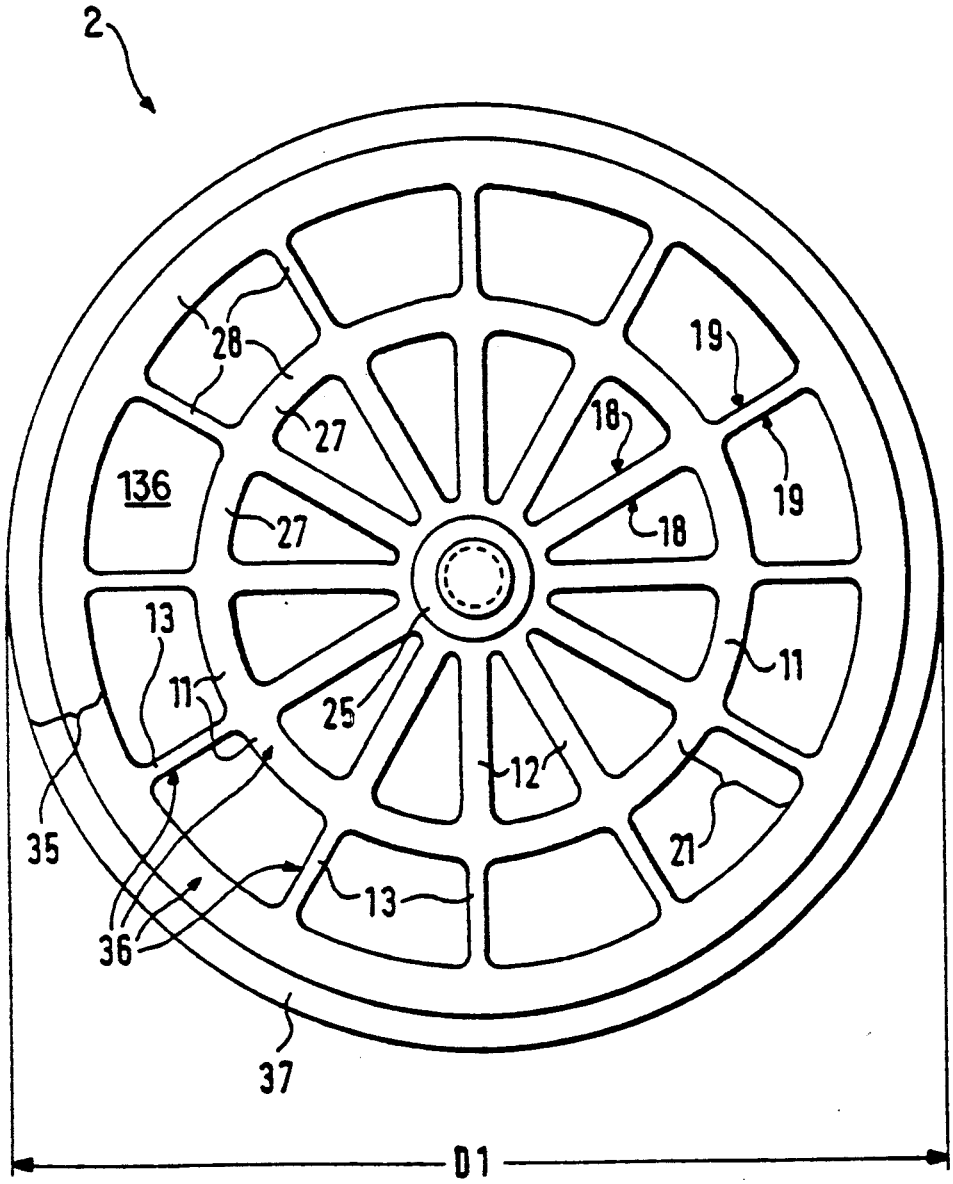
FIG. 3 is a smaller-scale bottom plan view of the diaphragm in the pump of FIG. 2.

The annular flexure zone 11 of the intermediate portion IP is provided with an annular protuberance 27 in the form of a circumferentially complete bead or rib at the second or rear side 14 of the diaphragm 2 (see also FIG. 3). The protuberance 27 of the flexure zone 11 establishes a connection between the additional annular zones 21 and 7 of the intermediate portion IP. In addition, the intermediate portion IP is provided with novel and improved stabilizing means 36 (FIG. 3) at the rear side 14 of the diaphragm 2. The illustrated stabilizing means 36 resembles a skeleton frame having a first set of substantially radially disposed straight reinforcing members 12 in the form of ribs or teeth extending between the protuberance 27 and the central portion 10 and a second set of substantially radially disposed elongated reinforcing members in the form of ribs or teeth 13 which extend between the protuberance 27 and the marginal portion 35. Thus, the ribs 12 are integral with the annular zone 7 (as well as with the central portion 10 and protuberance 27), and the ribs 13 are integral with the annular zone 21 (as well as with the protuberance 27 and the marginal portion 35 of the diaphragm 2). All of these ribs are disposed at the rear side 14 of the diaphragm 2. The radially outermost portions of top lands 44 of the inner ribs 12 merge gradually into and are flush with the annular top land 26 of the protuberance 27, and the top land 26 is further flush with the top lands 43 of the outer ribs 13.

The illustrated reinforcing members in the form of ribs or teeth 12, 13 can be replaced with other reinforcing members, e.g., by beads, without departing from the spirit of the invention. The illustrated reinforcing members 12, 13 in the form of elongated ribs or teeth with flat top lands 44, 43 and flat lateral surfaces or flanks 18 (ribs 12) and 19 (ribs 13) are preferred at this time because their exposed surfaces are relatively large so that they can dissipate large amounts of heat.

The annular zone 21 of the intermediate portion IP includes a relatively thin membrane 29 which is adjacent the front side 20 of the diaphragm 2 and has a thickness d, e.g., a thickness which matches or approximates the thickness of the ribs 13. The membrane 29 resembles a washer and its thickness d (this thickness is measured in a direction from the first or front side 20 toward the rear side 14 of the diaphragm 2) is or can be at least substantially constant. The thickness d is considerably less than the average thickness dm of the central portion 10 and is also considerably less than the average thickness d2 of the major part of the marginal portion 35. The thickness dm can match or exceed the thickness d2. The thickness dm denotes the average thickness of the central portion 10 without the nipple 25.

The outer ribs 13 merge directly into the protuberance 27 of the flexure zone 11 (as at 13*a*), and the inner ribs 12 also merge into the protuberance 27 (as at 12*a* in FIG. 2). The diaphragm 2 is made of an elastomeric material, e.g., rubber or a suitable synthetic plastic substance. The rigidity or stiffness of the central portion 10 of the elastomeric diaphragm 2 can be selected practically at will by appropriate selection of the dimensions and material of the insert including the portions 23, 24 and the shank 17. On the other hand, the nature of the material of the diaphragm 2 determines the deformability of that part of the central portion 10 which is disposed between the portion 23 of the insert and the front side 20 of the diaphragm. The disc-shaped portion 23 of the insert is preferably round and can but need not have a constant thickness. As can be seen in FIG. 2, the entire disc-shaped portion 23 of the insert is embedded in the elastomeric material of the central portion 10. This ensures that the insert can pull the central portion 10 in a direction away from the inner side 4 as well as push the central portion 10 toward the inner side 4 of the cover D.

The top lands 44 of the inner ribs 12 make an acute angle W with a plane (denoted by a line L) which is normal to the axis 28 of the insert 17, 23, 24, i.e., such plane is normal to the direction (denoted by arrow 16) of reciprocatory movement of the central portion 10 between its first or front and second or rear end positions. The angle W is selected in such a way that each rib 12 can transmit forces to the aligned rib 13 by way of the respective portion of protuberance 27 of the flexure zone 11 of intermediate portion IP of the diaphragm 2. The illustrated angle W is approximately 30°. FIG. 2 further shows that the radially innermost portions of top lands 44 of the inner ribs 12 merge into the rear end face of the nipple 25, namely into that end face of the nipple which faces away from the cover D.

FIG. 3 shows that the inner ribs 12 extend substantially radially of the axis of the central portion 10 and its nipple 25 and that each rib 12 is aligned with one of the ribs 13. The design of the diaphragm 2 is preferably such that the central portion 10 and the inner ribs undergo a minimum of deformation, i.e., that pronounced deformation in response to reciprocation of the central portion 10 takes place at and radially outwardly of the flexure zone 11. Thus, the ribs 12 should transmit deformation-causing forces to the aligned ribs rather than undergoing deformation in response to movements of the central portion 10 toward and away from the inner side 4 of the cover D.

The thickness d2 of the marginal portion 35 of the diaphragm 2 can equal the combined thickness of the membrane 29 and a rib 13, i.e., d2 can equal or approximate 2d. Furthermore, d2 can equal or approximate the thickness of the flexure zone 11. For example, d2 can equal or approximate 1.25 mm and the ratio of the thickness d to diameter D1 of the diaphragm 2 can be between 1:60 and 1:120.

FIG. 3 shows that the protuberance 27 of the flexure zone 11 can be said to constitute an inner ring and that the marginal portion 35 of the diaphragm 2 can be said to constitute an outer ring of the skeleton frame of the stabilizing means 36 at the rear side 14 of the diaphragm. The ribs 13 of the annular zone 21 cooperate with the rings 27 and 35 to define an annulus of trapeziform recesses or depressions 36 each of which extends between the rear side 14 of the diaphragm and the membrane 29. Each recess 136 is bounded by four frame members 28.

The central portion 10 of the diaphragm is stabilized and reinforced as well as stiffened by the insert including the portions 23, 24 and shank 17 as well as by major portions of the ribs 12. The intermediate portion IP is stabilized by the radially outermost portions of the ribs 12, by the protuberance 27 of the flexure zone 11, and by the ribs 13 at the rear side of the membrane 29. The diaphragm 2 is deformed primarily at the flexure zone 11 and at the outer annular zone 21. The ribs 13 cooperate with the protuberance 27 and with the marginal portion 35 to prevent excessive deformation of the membrane 29 while the central portion 10 is moved forwardly and backwards between its two end positions. All of the above described undertakings regarding the dimensioning and shape of the diaphragm 2 contribute to a reduction of the fulling action and hence to prevention of overheating of the diaphragm. This prolongs the useful life of the diaphragm.

The radially outermost part of the marginal portion 35 is provided with a circumferentially complete annular flange 37 which is snugly received in and fills a complementary annular recess or groove 38 in the adjacent end face of the case or section K of the pump hosing. The flange 37 ensures reliable anchoring of the marginal portion 35 in the section K so that the marginal portion 35 cannot perform any movements radially of the axis 28 and thereby contributes to more predictable deformation of the intermediate portion IP in response to reciprocation of the central portion 10 with the adjacent end of the connecting rod 3*a*.

Figure 4:
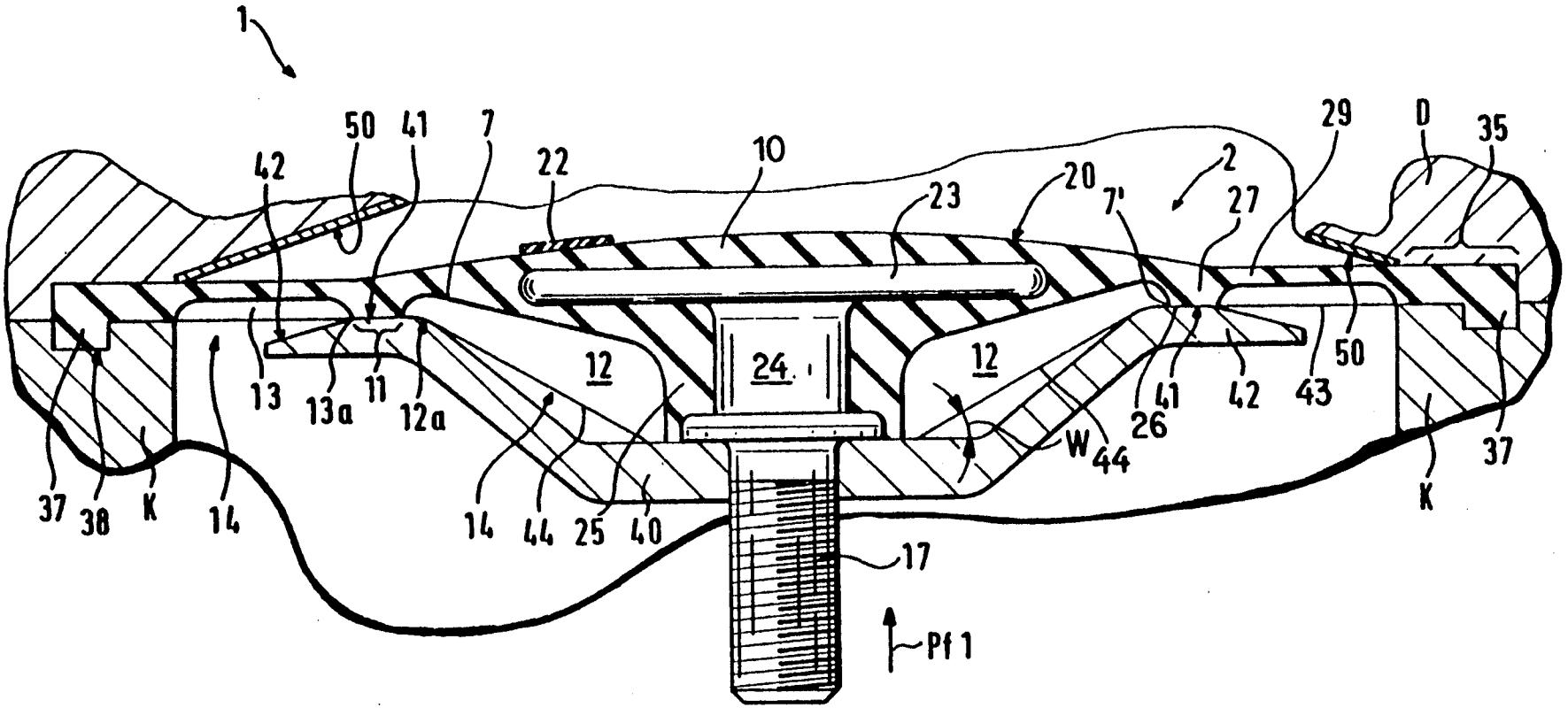
FIG. 4 is a sectional view similar to that of FIG. 2 but showing a modified diaphragm pump which comprises a support for the flexure zone and certain reinforcing members.
Figure 5:
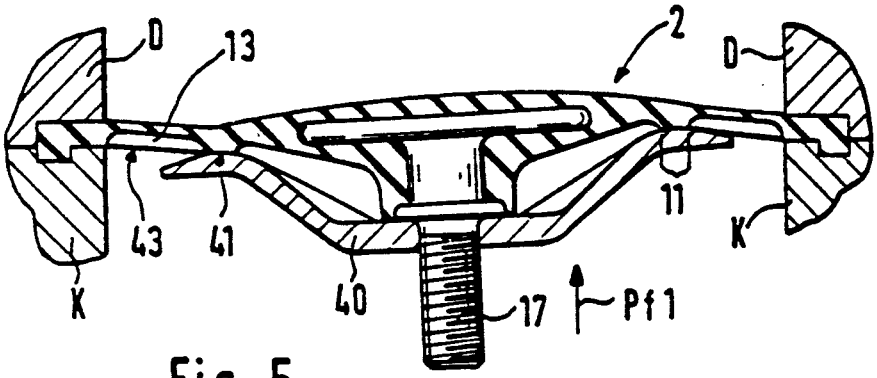
FIG. 5 is a smaller-scale sectional view corresponding to that of FIG. 4, the diaphragm being shown in an intermediate position.

The first or front side 20 of the diaphragm 2 can be coated with a relatively thin layer or film 22 (a portion of such film is shown in FIG. 4) which is made of a material that is not affected by the corrosive or other undesirable influence of a fluid medium in the pumping chamber 5. This film shields the elastomeric material of the diaphragm 2, especially if the fluid medium is likely to attack the diaphragm along the front side 20. For example, the film 22 can consist of or can contain poletetrafluoroethylene. The exact composition and/or the thickness of the film 22 will be selected in dependency upon characteristics of the fluid medium which enters the pumping chamber 5 by way of the inlet E during each aspiration stroke of the central portion 10 to leave the chamber 5 by way of the outlet A during the next-following exhaust stroke. For example, the film 22 can have a thickness in the range of 0.25 mm.

A similar or another film (see FIG. 4) can be applied to the inner side 4 of the cover D.

The central portion of the inner side 4 of the cover D is a concave surface, and such concave surface is surrounded by a substantially frustoconical portion 50 which is tangential to the concave portion. The frustoconical portion 50 extends outwardly all the way to the locus (at 34) where the cover D sealingly engages the radially innermost part of the marginal portion 35 of the diaphragm 2.

It has been found that the dead space between the inner side 4 of the cover D and the front side 20 of the diaphragm 2 is nil or at least much smaller than in a conventional diaphragm pump, even if the aforediscussed convex part 104' of the inner side 104 of the pump 101 in FIG. 1 is omitted. This contributes to lower cost of the cover D in the improved diaphragm pump 1. Reduction or elimination of the dead space in the first end position of the central portion 10 is attributable to the aforediscussed configuration of the diaphragm 2, particularly of its central portion 10 (with insert 23, 24, 17) and even more particularly of its intermediate portion IP with the flexure zone 11 and stabilizing means 36 including the ribs 12 and/or 13.

It has also been found that the improved plump 1 can be used not only as a vacuum pump but also for positive displacement of gaseous or hydraulic fluid media, i.e., as a machine for raising the pressure of the conveyed fluid medium. Such versatility of the improved pump 1 is enhanced if the ribs 12 of the stabilizing means at the rear side 14 of the diaphragm 2 are designed with a view to ensure that they oppose deformation of the central portion 10 during each exhaust stroke and that they pull the flexure zone 11 away from the inner side 4 of the cover D during each aspiration stroke of the central portion 10. Otherwise stated, the ribs 12 prop the central portion 10 during each exhaust stroke and act as a means for assisting the central portion 10 in drawing the flexure zone 11 and the annular zone 21 away from the inner side 4 of the cover D during each aspiration stroke. Such dual function of the ribs 12 can be readily achieved by appropriate selection of their dimensions, material and number.

The ability of the improved diaphragm pump to convey gaseous or hydraulic fluids at elevated pressures can be enhanced by the provision of a preferably dished rigid support 40 (shown in FIGS. 4 to 7) which is carried by the means for moving the central portion 10 of the diaphragm 2. FIG. 4 shows that the central part of the support 40 has a hole for the shank 17 so that its front side can abut the insert portion 24, and the support is held in an optimum position with reference to the rear side 14 of the diaphragm 2 by the front end of the connecting rod 3*a* (not shown in FIGS. 4–7) when the latter meshes with the shank 17. The central part of the support 40 is then clamped between the portion 24 of the insert and the rear end face of the nipple 25 on the one hand, and the front end face of the connecting rod 3*a* on the other hand. The front side of the central part of the support 40 is located in a plane which is normal to the axis of the shank 17, and such front side makes with the top land 44 of each inner reinforcing rib 12 an acute angle W which, as explained with reference to FIG. 2, can be in the range of 30°.

When the central portion 10 of the contoured diaphragm 2 is caused to perform an exhaust stroke (in the direction of arrow Pf1 in FIG. 4), the top land 26 of the protuberance 27 of the flexure zone 11 abuts the front surface 41 of the rigid support 40 all the way between the radially outermost ends of the inner ribs 12 and the radially innermost ends of the outer ribs 13. This limits the extent of movability of the flexure zone 11 relative to the central portion 10 in a direction away from the cover D of the pump housing. The position of the front surface 41 is selected in such a way that the ribs 12 and 13 are in an optimum orientation relative to each other when the front surface 41 is engaged by the top land 26 of the protuberance 27.

The annular rim 42 of the dished support 40 is preferably configurated in such a way that it serves as an abutment or stop for the outer ribs 13 of the stabilizing means 36 not later than when the central portion 10 of the diaphragm 2 approaches (FIG. 5) or reaches (FIG. 6) its first end position (completion of an exhaust stroke). On the other hand, the outer ribs 13 can move away from the rim 42 not later than when the central portion 10 reaches its second or rear end position (FIG. 7), i.e., the end of its aspiration stroke. That portion of the front surface 41 which constitutes the front side of the rim 42 preferably resembles the frustum of a cone which tapers from the marginal portion 35 toward the central portion 10 in a direction toward the cover D. The conicity of the conical marginal portion of the surface 41 can be readily selected in such a way that at least the radially innermost portions of the top lands 43 of the ribs 13 abut such conical portion not later than when the central portion 10 reaches the front end position of FIG. 6.

The support 40 constitutes an optional but desirable and advantageous feature of the improved diaphragm pump. Such support can be utilized with particular advantage in diaphragm pumps which embody the novel diaphragm 2 and are used to pressurize the fluid medium flowing from the inlet E to the outlet A of the cover D.

An important advantage of the improved diaphragm 2 is that its average thickness can be less than that of a conventional diaphragm (such as the diaphragm 102 of FIG. 1). The reason is that the central portion 10 is adequately reinforced by the insert (17, 23, 24) and that the relatively thin intermediate portion IP is adequately reinforced by the annular flexure zone 11 and the reinforcing ribs 12 and/or 13. A reduction of the mass or bulk of the diaphragm is desirable because this ensures that the fulling action is less pronounced so that the diaphragm is not overheated and can stand longer periods of use. Moreover, a diaphragm having a lesser bulk or mass can be deformed by weaker moving means whose energy requirements are relatively low, and the overall weight of the diaphragm pump is also reduced. A reduction of the weight and mass of the diaphragm entails a reduction of the inertia of moving parts and simplifies the task of compensating for the remaining inertia. This, in turn, reduces the tendency of the improved pump to perform vibratory and/or other stray movements. For example, the extent of vibratory movements can be reduced below or does not exceed 0.2 mm.

The stabilizing means 36 of the improved diaphragm 2 can include only the reinforcing ribs 12 or only the reinforcing ribs 13. It is presently preferred to provide ribs radially inwardly as well as radially outwardly of the flexure zone 11 because this renders it possible to reduce the thickness of the remaining part of the intermediate portion IP without risking excessive deformability of the flexure zone 11, of the additional annular zone 21 and/or of the additional annular zone 7. This is due to the establishment of the aforediscussed skeleton frame which is the presently preferred form of the stabilizing means and, in addition to the ribs 13, further includes the marginal portion 35 and the flexure zone 11. This skeleton frame is further reinforced by the ribs 12 between the protuberance 27 of the flexure zone 11 and the nipple 25 of the central portion 10. The stabilizing means 36 renders it possible to greatly reduce the thickness or average thickness of the remaining part of the intermediate portion IP with the aforediscussed advantages including lower weight, smaller mass, less pronounced inertia and reduced likelihood of overheating as a result of fulling action.

The aforediscussed feature that the inner reinforcing ribs 12 resist deformation of the central portion 10 during exhaust strokes of the diaphragm 2 and pull the flexure zone 11 and the additional zone 21 away from the inner side 4 of the cover D during aspiration strokes of the central portion 10 reduces the likelihood of excessive vibration of the diaphragm 2 as well as the likelihood of transmission of excessive vibrations to the diaphragm when the pump 1 is in actual use. In addition, such design of the ribs 12 reduces the likelihood of generation of pronounced noise when the pump is called upon to alternatively maintain the conveyed fluid medium at a superatmospheric and a subatmospheric pressure. The just discussed advantages are even more pronounced if the stabilizing means 36 includes the ribs 12 as well as the ribs 13 and the stability of the ribs 13 is selected with a view to prevent excessive deformation of the intermediate portion IP during each exhaust stroke of the central portion 10.

The support 40 can be made of a metallic or other suitable rigid material. Its function is to further reduce the likelihood of uncontrolled deformation of portions 10 and IP of the diaphragm 2, particularly during each exhaust stroke of the central portion 10. At such time, the intermediate portion IP tends to undergo excessive deformation in a direction toward the interior of the section K of the pump housing. Thus, when the improved pump 1 embodies a support 40 or an analogous support, it can be used with advantage as a means for pressurizing the conveyed fluid medium. The support 40 can be put to use under circumstances when the pressure of fluid in the pumping chamber 5 would be likely to cause unpredictable and excessive deformation of the intermediate portion IT in a sense to reduce the likelihood of elimination or pronounced reduction of dead space between the inner side 4 of the cover D and the front side 20 of the diaphragm 2 in the front end position of the central portion 10.

The support 40 is preferably mounted in such a way that it is readily accessible and can be rapidly removed from or reinserted into the section K of the pump housing. This renders it possible to enhance the versatility of the improved pump in that the support 40 is removed when the pump is to convey fluid media at a relatively low pressure and the support is simply reinserted when the fluid medium must or should be conveyed at a higher pressure. Thus, it is not necessary to furnish the improved pump with a large number of diaphragms 2 (the insertion or removal of a diaphragm necessitates at least partial dismantling of the pump because the marginal portion 35 is clamped between the cover D and the housing section K) since it normally suffices to supply the pump with a single diaphragm (or with a small number of diaphragms) and a support 40.

The aforediscussed relationships between the thicknesses of various portions of the improved diaphragm 2 also contribute to a relatively small mass and lower weight and reduce the fulling action which must be performed when the improved pump is in actual use. Such relationships have been found to ensure satisfactory resistance to deformation and enable the pump to convey large quantities of fluid media per unit of time a well as to establish high vacua (if the pump is used as a vacuum pump).

The aforediscussed (partly concave and partly frustoconical) configuration of the inner side 4 of the cover D is desirable and advantageous because the inner side of the cover can be shaped at a low cost in available machines or machine tools without and does not adversely affect the output and/or vacuum generating action of the pump. Thus it is not necessary to provide the inner side 4 with a protuberance of the type shown at 104' in FIG. 1 in order to achieve a desirable pronounced reduction of dead space between the diaphragm and the cover when the central portion 10 completes its exhaust stroke.

The provision of a relatively narrow flexure zone 11 contributes to a reduction of the mass or bulk of the diaphragm 2 and hence to a reduction of the fulling action. Such relatively narrow flexure zone 11 has been found to suffice because the diaphragm further comprises the ribs 12 and/or 13 which connect the flexure zone with the central portion 10 and/or with the marginal portion 35. The feature that the top land 26 of the protuberance 27 of the flexure zone 11 is flush with the adjacent portions of top lands 44, 43 of the ribs 12, 13 renders it possible to simplify the machine in which the diaphragm is made.

The nipple 25 cooperates with the ribs 12 and with the flexure zone 11 to enhance the ability of the central portion 10 to resist undesirable deformation. Moreover, this nipple cooperates with the ribs 12 to enhance the uniformity of design of the central portion 10 and of the additional annular zone 7; this enhances the uniformity and predictability of the plumping action and reduces the likelihood of undesirable and excessive stretching of certain parts of the diaphragm. In addition, the fulling action is reduced with attendant longer useful life of the diaphragm and lower energy requirements of the means for reciprocating the central portion 10. The aforediscussed orientation of the outer ribs 13 (so that each of these ribs is aligned with one of the ribs 12) also contributes to a reduction of the fulling action and longer useful life of the diaphragm as well as to lower energy requirements of the pump due to an optimum design of the corresponding part of the intermediate portion IP, namely of the additional annular zone 21 between the flexure zone 11 and the marginal portion 35.

Proper anchoring of the marginal portion 35 between the housing sections D and K (particularly due to the provision of the flange or bead 37) reduces the tendency of the pump and of its diaphragm to vibrate and reduces the generation of noise when the pump is in use.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A pump comprising a housing including a first section and a second section said first section having an inner side facing said second section, a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section; and means for moving said central portion between a first position in which said first side is closely adjacent and at least substantially conforms to said inner side and a second position in which said first side is remote from said inner side, said intermediate portion including an annular flexure zone where said diaphragm is flexed during movement of said central portion between said positions and stabilizing means provided at said second side and including a portion dispersed between said flexure zone and at least one of said central and marginal portions, said stabilizing means including at least one first reinforcing member between said marginal portion and said intermediate portion, and at least one second reinforcing member between said central portion and said intermediate portion.

2. A pump comprising a housing including a first section and a second section, said first section having an inner side facing said second section, a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section; and means for moving said central portion between a first position in which said first side is closely adjacent and at least substantially conforms to said inner side and a second position in which said first side is remote from said inner side, said intermediate portion including an annular flexure zone where said diaphragm is flexed during movement of said central portion between said positions and stabilizing means provided at said second side and including a portion disposed between said flexure zone and at least one of said central and marginal portions, said intermediate portion further comprising at least one additional annular zone and one of said zones being surrounded by the other of said zones, said flexure zone having a first thickness and said at least one additional zone having a second thickness less than said first thickness, said flexure zone including an annular protuberance at the second side of said diaphragm and said protuberance having a top land facing away from said first section, said stabilizing means including at least one reinforcing rib having a top land substantially flush with the top land of said protuberance.

3. A pump comprising a housing including a first section and a second section, said first section having an inner side facing said second section, a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section, said central portion including a nipple at said inner side; and means for moving said central portion between a first position in which said first side is closely adjacent and at least substantially conforms to said inner side and a second position in which said first side is remote from said inner side, said intermediate portion including an annular flexure zone where said diaphragm is flexed during movement of said central portion between said positions and stabilizing means provided at said second side and including a portion disposed between said flexure zone and at least one of said central and marginal portions, said stabilizing means including a plurality of reinforcing ribs between said flexure zone and said nipple and said flexure zone including an annular protuberance at said second side, said ribs having top lands facing away from said first section and said protuberance having a top land which is substantially flush with the top lands of said ribs.

4. A pump comprising a housing including a first section and a second section, said first section having an inner side facing said second section, a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section, said central portion including a nipple at said second side; and means for moving said central portion between a first position in which said first side is closely adjacent and at least substantially conforms to said inner side and a second position in which said first side is remote from said inner side, said intermediate portion including an annular flexure zone where said diaphragm is flexed during movement of said central portion between said positions and stabilizing means provided at said second side and including a portion disposed between said flexure zone and at least one of said central and marginal portions, said stabilizing means including a plurality of reinforcing ribs between said flexure zone and said nipple and said ribs extending substantially radially of said nipple, said stabilizing means further comprising additional reinforcing ribs between said flexure zone and said marginal portion and each of said additional ribs being at least substantially aligned with a rib between said flexure zone and said central portion.

5. A pump comprising a housing including a first section and a second section, said first section having an inner side facing said second section, a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section; and means for moving said central portion between a first position in which said first side is closely adjacent and at least substantially conforms to said inner side and a second position in which said first side is remote from said inner side, said intermediate portion including an annular flexure zone where said diaphragm is flexed during movement of said central portion between said positions and stabilizing means provided at said second side and including a portion disposed between said flexure zone and at least one of said central and marginal portions, said intermediate portion including an annular membrane disposed at said first side and extending between said flexure zone and said marginal portion, said stabilizing means including reinforcing ribs integral with said membrane at said second side of said diaphragm, said marginal portion having a first thickness and said membrane and said ribs having a combined second thickness which at most equals said first thickness.

6. A pump comprising a housing including a first section and a second section, said first section having an inner side facing said second section, a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section; and means for moving said central portion between a first position in which said first side is closely adjacent and at least substantially conforms to said inner side and a second position in which said first side is remote from said inner side, said intermediate portion including an annular flexure zone where said diaphragm is flexed during movement of said central portion between said positions and stabilizing means provided at said second side and including a portion disposed between said flexure zone and at least one of said central and marginal portions, said intermediate portion further comprising an annular membrane which overlies said stabilizing means and has a thickness between 1/60 and 1/120 of the diameter of said diaphragm.

7. A pump comprising a housing including a first section and a second section, said first section having an inner side facing said second section and said inner side including a concave portion having a first radius of curvature and a substantially frustoconical portion which surrounds said concave portion, said first section further having a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section; and means for moving said central portion between a first position in which said first side is closely adjacent and at least substantially conforms to said inner side and a second position in which said first is remote from said inner side, said first side including a portion which is convex, at least in said first position of said central portion and said portion of said first side having a radius of curvature which matches or approximates said first radius of curvature in the first position of said central portion, said intermediate portion including an annular flexure zone where said diaphragm is flexed during movement of said central portion between said positions and stabilizing means provided at said second side and including a portion disposed between said flexure zone and at least one of said central and marginal portions.

8. The pump of claim 7 wherein said frustoconical portion is substantially tangential to said concave portion of said inner side.

9. A pump comprising a housing including a first section and a second section, said first section having an inner side facing said second section, a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section; and means for moving said central portion between a first position in which said first side is closely adjacent and at least substantially conforms to said inner side and a second position in which said first side is remote from said inner side, said intermediate portion including an annular flexure zone where said diaphragm is flexed during movement of said central portion between said positions and stabilizing means provided at said second side and including a portion disposed between said flexure zone and at least one of said central and marginal portions, said stabilizing means including a skeleton frame and said flexure zone and said marginal zone forming part of said skeleton frame, said marginal portion and said flexure zone respectively constituting outer and inner rings of said skeleton frame and said portion of said stabilizing means including a reinforcing ribs extending between said rings and defining with said rings an annulus of substantially trapeziform recesses.

10. The pump of claim 9, wherein said intermediate portion further comprises an annular membrane which overlies and is integral with said ribs, said membrane being disposed at the first side of said diaphragm.

11. A pump comprising a housing including a first section and a second section, said first section having an inner side facing said second section, a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section; means for moving said central portion between a first position in which said first side is closely adjacent and at least substantially conforms to said inner side and a second position in which said first side is remote from said inner side, said intermediate portion including an annular flexure zone where said diaphragm is flexed during movement of said central portion between said positions and stabilizing means provided at said second side and including a portion disposed between said flexure zone and at least one of said central and marginal portions; and a rigid support provided on said moving means at the second side of said diaphragm, said flexure zone abutting said support at least during movement of said central portion toward said first position.

12. The pump of claim 11, wherein said support abuts said stabilizing means at least during movement of said central portion toward said first position.

13. The pump of claim 12, wherein said support has a surface which lies flush at least against a part of said flexure zone and at least against a part of said stabilizing means, at least during movement of said central portion toward said first position.

14. The pump of claim 11, wherein said support is dished and includes a rim which abuts the second side of said diaphragm at least during movement of said central portion toward said first position.

15. The pump of claim 14, wherein said rim abuts said second side in the region of said flexure zone.

16. The pump of claim 14, wherein said rim extends beyond said flexure zone toward said marginal portion, said stabilizing means including reinforcing ribs between said flexure zone and said marginal portion, said rim abutting said ribs at least in the first position of said central portion.

17. The pump of claim 16, wherein said rim has a conical surface which tapers toward said second side and abuts said ribs at least in the first position of said central portion.

18. A pump comprising a housing including a first section and a second section, said first section having an inner side facing said second section, a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section; and means for moving said central portion between a first position in which said first side is closely adjacent and at least substantially conforms to said inner side and a second position in which said first side is remote from said inner side, said intermediate portion including an annular flexure zone where said diaphragm is flexed during movement of said central portion between said positions and stabilizing means provided at said second side and including a portion disposed between said flexure zone and at least one of said central and marginal portions, said stabilizing means including a first set of reinforcing ribs between said central portion and said flexure zone and a second set of reinforcing ribs between said flexure zone and said marginal portion, the ribs of said first set having top lands facing away from said pumping chamber and making an acute angle with a plane which is normal to the direction of movement of said central portion between said first and second positions, said top lands sloping from said central portion toward said flexure zone in a direction toward said pumping chamber.

19. The pump of claim 18, wherein the magnitude of said angle is such that the ribs of said first set transmit deformation-opposing forces to the ribs of said second set during movement of said central portion toward said first position.

20. A pump comprising a housing including a first section and a second section, said first section having an inner side facing said second section, a fluid-admitting inlet and a fluid-discharging outlet; a contoured deformable diaphragm including an annular marginal portion which is sealingly received between said sections, a central portion and an annular intermediate portion between said central and marginal portions, said diaphragm having a first side defining with said inner side a pumping chamber which communicates with said inlet and said outlet and a second side facing away from said first section; and means for moving said central portion between a first position in which said first side is closely adjacent and at least substantially conforms to said inner side is remote from said inner side, said intermediate portion including an annular flexure zone where said diaphragm is flexed during movement of said central portion between said positions and stabilizing means provided at said second side and including a portion disposed between said flexure zone and at least one of said central and marginal portions, said flexure zone including an annular protuberance at the second side of said diaphragm.

21. The pump of claim 20, wherein said stabilizing means comprises at least one reinforcing rib.

22. The pump of claim 20, wherein said central, marginal and intermediate portions of said diaphragm have first, second and third thicknesses, respectively, and said first thickness exceeds at least one of said second and third thicknesses.

23. The pump of claim 20, wherein said intermediate portion has a first thickness and said central portion has an average thickness exceeding said first thickness.

24. The pump of claim 20, wherein said inner side includes a concave portion having a first radius of curvature and said first side includes a portion which is convex, at least in said first position of said central portion, said portion of said first side having a radius of curvature which matches or approximates said first radius of curvature in the first position of said central portion.

25. The pump of claim 20, wherein said intermediate portion further comprises at least one additional annular zone, one of said zones being surrounded by the other of said zones and said flexure zone having a first thickness, said at least one additional zone having a second thickness less than said first thickness.

26. The pump of claim 20, wherein said intermediate portion includes an additional annular zone between said flexure zone and said marginal portion, said marginal portion having a first thickness and said additional annular zone having a second thickness less than said first thickness.

27. The pump of claim 20, wherein said stabilizing means includes a skeleton frame, said flexure zone and said marginal portion forming part of said skeleton frame.

28. The pump of claim 20, wherein said stabilizing means comprising reinforcing ribs disposed between said flexure zone and said central portion to oppose deformation of said intermediate portion between said flexure zone and said central portion during movement of said central portion toward said first position and to pull said flexure zone away from said inner side during movement of said central portion toward said second position.

29. The pump of claim 20, further comprising means for coupling said central portion to said moving means, said coupling means having a substantially T-shaped cross-sectional outline and including a first portion which is at least partially embedded in said central portion and a second portion which connects said first portion with said moving means.

30. The pump of claim 20, wherein said stabilizing means includes elongated reinforcing ribs having substantially flat flanks.

31. The pump of claim 20, further comprising a stiffening insert in said central portion.

32. The pump of claim 31, wherein said insert includes a first portion which is at least substantially embedded in said central portion and a second portion which connects said first portion and said central portion with said moving means.

33. The pump of claim 32, wherein said moving means includes a connecting rod which is coupled with the second portion of said insert.

34. The pump of claim 20, wherein said central portion includes a nipple at said second side and said stabilizing means includes a plurality of reinforcing ribs between said flexure zone and said nipple.

35. The pump of claim 34, wherein said ribs extend substantially radially of said nipple.

36. The pump of claim 20, wherein said marginal portion includes an annular flange and one of said sections has a complementary recess for said flange.

37. The pump of claim 36, wherein said flange is provided at the second side of said diaphragm and said recess is provided in said second section.

38. The pump of claim 20, further comprising a film which overlies said first side and consists of a material which is inert to the fluid entering said chamber by way of said inlet.

39. The pump of claim 38, wherein said film contains polytetrafluoroethylene.

* * * * *